US006386074B1

(12) United States Patent
Yang

(10) Patent No.: US 6,386,074 B1
(45) Date of Patent: May 14, 2002

(54) ARTICULATED SCREWDRIVER

(76) Inventor: Tzung-Yen Yang, No. 246, Cherng-Kung 2 Rd., Da-Li City, Taichung Hsien (TW)

( * ) Notice: Subject to any disclaimer, the term of this patent is extended or adjusted under 35 U.S.C. 154(b) by 0 days.

(21) Appl. No.: 09/849,728

(22) Filed: May 4, 2001

(51) Int. Cl.[7] ..... B25B 23/16
(52) U.S. Cl. ..... 81/177.7; 81/177.75
(58) Field of Search ..... 81/177.8, 177.7, 81/177.75, 480, 450; 403/51, 83

(56) References Cited

U.S. PATENT DOCUMENTS 1,643,855 A * 9/1927 Peterson ..... 81/177.75
2,773,529 A * 12/1956 Valenti ..... 81/177.7
3,855,884 A * 12/1974 McPeak ..... 81/177.75
5,515,754 A * 5/1996 Elkins ..... 81/177.7
5,517,884 A * 5/1996 Sanders ..... 81/177.7
6,105,473 A * 8/2000 Huang ..... 81/177.75

* cited by examiner

*Primary Examiner*—Eileen P. Morgan
*Assistant Examiner*—Joni B. Danganan
(74) *Attorney, Agent, or Firm*—Alan Kamrath; Rider, Bennett, Egan & Arundel, LLP

(57) ABSTRACT

An articulated screwdriver has a handle and a shank secured on the handle. The shank has a ball-end formed at a free end thereof, and an outer thread formed on an outer periphery close to the free end. A joint sleeve has a joint formed at a first end thereof and an opening defined at a second end. The ball-end is pivotally mounted in the opening. A positioning sleeve screwed on the shank has an inner thread engaged with the outer thread. Whereby, when the positioning sleeve is moved forwards to enter the opening, the shank is unable to be pivoted about the joint sleeve and when the positioning sleeve is distant from the opening the joint sleeve is able to pivot relative to the shank.

6 Claims, 5 Drawing Sheets

ARTICULATED SCREWDRIVER

BACKGROUND OF THE INVENTION

1. Field of the Invention

The present invention is related to an articulated screwdriver, and more particularly to an articulated screwdriver that is operable in a pivot mode and a non-pivot mode.

2. Description of Related Art

When screws are located at some sheltered positions, it is difficult to access and turn them by using conventional screwdrivers due to the restricted space. Therefore, articulated screwdrivers are available for turning the screws at the special positions. One of the articulated screwdrivers is shown in FIG. 5.

The articulated screwdriver has a pivoting part (7) assembled between a handle (80) and a chuck sleeve (81). The pivoting part (7) has a shank (70) secured on the handle (80). The shank (70) is pivotally mounted with a joint (72). A square stub (71) is formed at a front end of the joint (72) and assembled with the chuck sleeve (81). A tip (82) is detachably assembled at a front end of the chuck sleeve (81).

When a user wants to turn a screw in a sheltered position, the shank (70) is able to be pivoted about the joint (72). However, when the user turns screws in non-sheltered positions, the screwdriver need not be pivoted and the shank (70) must be aligned with the joint (72). However, it is very inconvenient for the user to retain the shank (70) in alignment with the joint (72) in turning the screwdriver, because the the joint (72) lacks the rigidity with the shank (70) required in this situation.

Therefore, the invention provides an articulated screwdriver to mitigate and/or obviate the aforementioned problems.

SUMMARY OF THE INVENTION

The main objective of the invention is to provide an articulated screwdriver that is operable in both a pivot mode and a non-pivot mode. Other objects, advantages and novel features of the invention will become more apparent from the following detailed description when taken in conjunction with the accompanying drawings.

DETAILED DESCRIPTION OF THE PREFERRED EMBODIMENT

Figure 1:
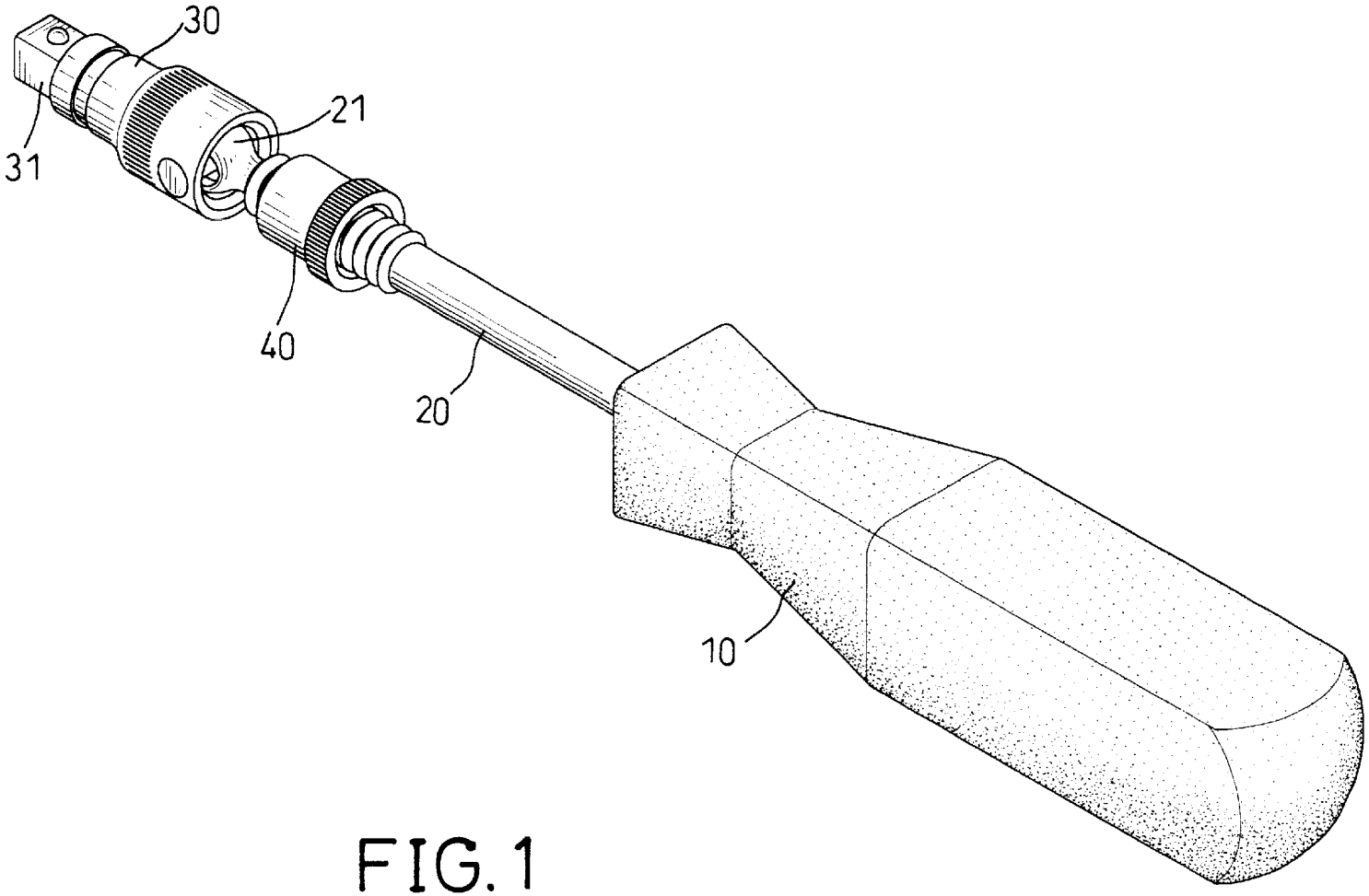
FIG. 1 is a perspective view of an articulated screwdriver in accordance with the invention.
Figure 2:
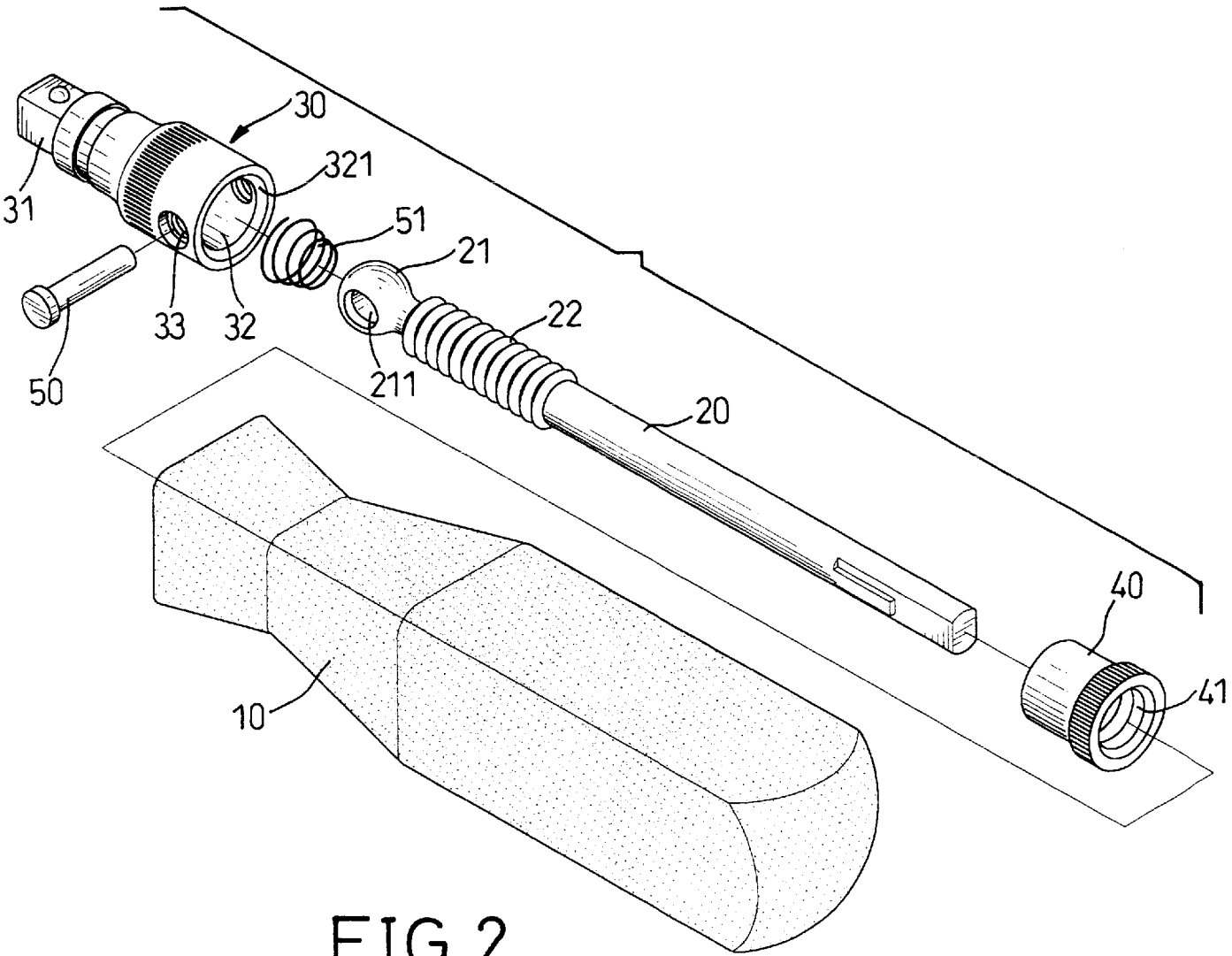
FIG. 2 is an exploded perspective view of the articulated screwdriver in accordance with the invention.

Referring to FIGS. 1 and 2, an articulated screwdriver in accordance with the invention is composed of a handle (10), a shank (20), a joint sleeve (30) and a positioning sleeve (40). The shank (20) is secured on the handle (10) and has a ball-end (21) formed at a free end thereof. A slot (211) is transversally defined through the ball-end (21). An outer thread (22) is formed on an outer periphery of the shank (20) and close to the ball-end (21).

The joint sleeve (30) has a substantially cubic joint (31) formed at a first end thereof and an opening (32) defined at a second and thereof. A pair of apertures (33) is defined at diametrically opposite sides of the opening (32) respectively, and a step (321) is formed at an outer edge of the opening (32). The ball-end (21) is received in the opening (32) and the slot (211) is aligned with the apertures (33). A pin (50) is inserted through the apertures (33) and the slot (211) to enable the ball-end (21) to pivot about the joint sleeve (30). Moreover, a resilient member (51) is received in the opening (32) and abuts the ball-end (21).

The positioning sleeve (40) screwed on the shank (20) has an inner passage including an inner thread (41) engaged with the outer thread (22). The size of the inner passage of the positioning sleeve (40) is smaller than and for abutting with the ball-end (21) of the shank (20). The front end of the positioning sleeve (40) includes an outer diameter smaller than and for receipt in a diameter of the opening (32).

The positioning sleeve (40) screwed on the shank (20) has an inner thread (41) engaged with the outer thread (22).

Figure 3:
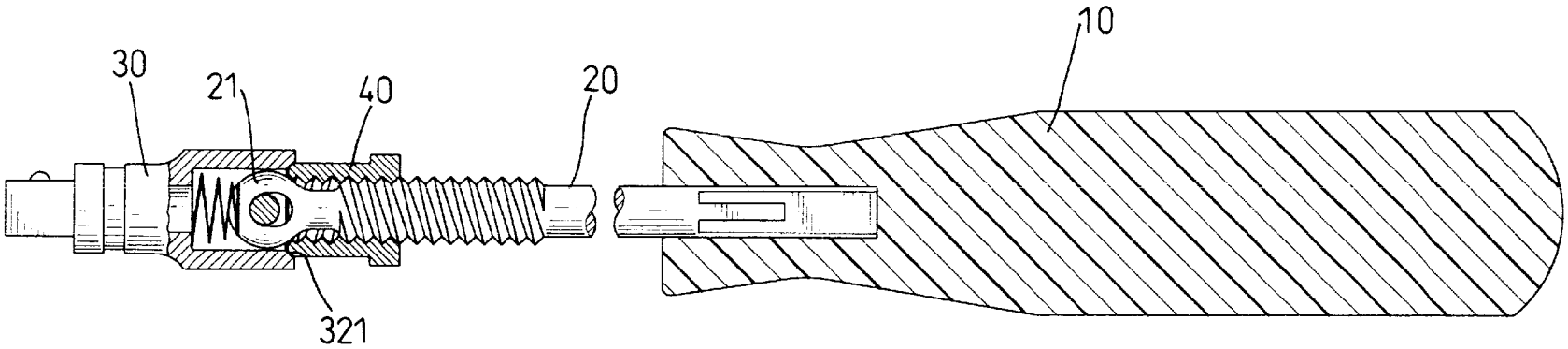
FIG. 3 is a sectional view of the articulated screwdriver.

Referring to FIG. 3, when the positioning sleeve (40) is screwed forwards to abut a front end thereof against the step (321), the ball-end (21) is unable to be pivoted about the joint sleeve (30). Thus, the shank (20) is aligned with the joint sleeve (30), which is convenient for a user to operate the screwdriver in a non-pivot mode.

Figure 4:
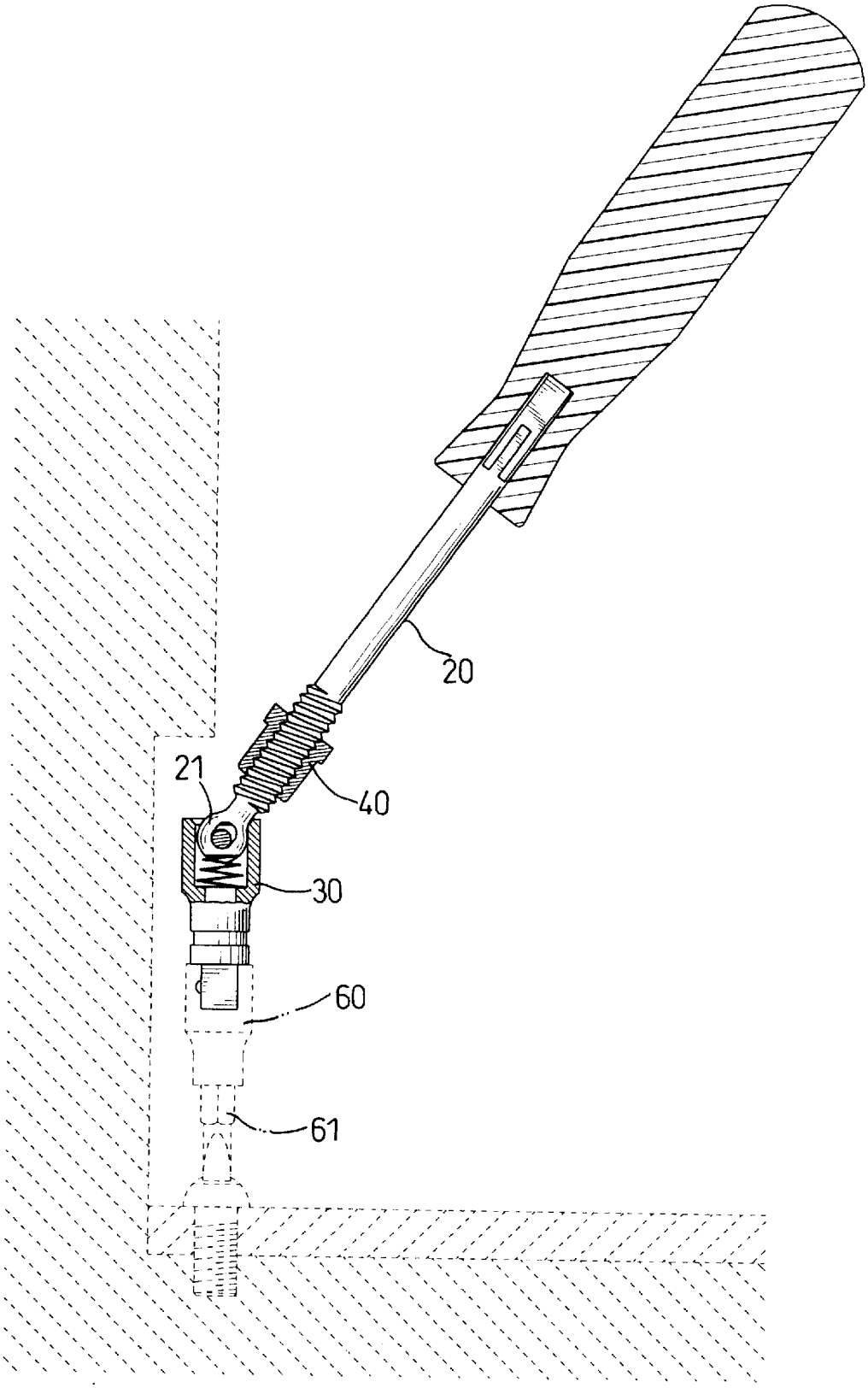
FIG. 4 is a schematic view showing the screwdriver being used to turn a screw in a sheltered position.
Figure 5:
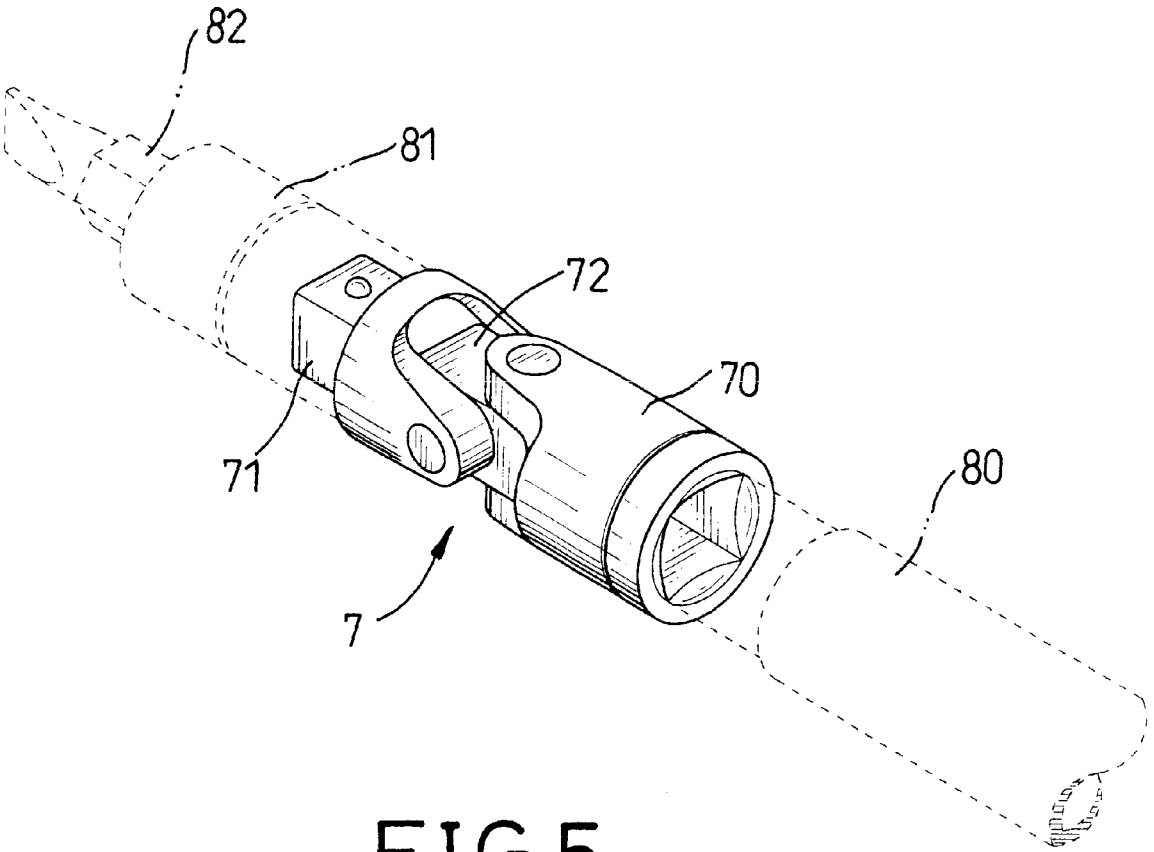
FIG.5 PRIOR ART
FIG. 5 is a perspective view of a conventional articulated screwdriver.

Referring to FIG. 4, when the positioning sleeve (40) is screwed backwards to disengage the front end thereof from the joint sleeve (30), the shank (20) is able to be pivoted about the joint sleeve (30). Thus, the user can conveniently turn the joint sleeve (30) with a chuck sleeve (60) and a tip (61) to tighten or loosen screws in restricted spaces.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An articulated screwdriver comprising:

a handle (10);

a shank (20) secured on the handle (10), the shank (20) having a free end (21) and an outer thread (22) formed on an outer periphery close to the free end (21);

a joint sleeve (30) having a joint (31) formed at a first end thereof and an opening (32) defined at a second end thereof, the free end (21) of the shank (20) being pivotally received in the opening (32); and a positioning sleeve (40) screwed on the shank (20), the positioning sleeve (40) having an inner passage including an inner thread (41) engaged with the outer thread (22) and of a size smaller than and for abutting with the free end (21), with the positioning sleeve having a front end including an outer diameter smaller than and for receipt in a diameter of the opening (32), whereby, when the front end of the positioning sleeve (40) is inserted in the opening (32), a longitudinal axis of the shank (20) rigidly aligns with a longitudinal axis of the joint sleeve (30) and the shank (20) is unable to be pivoted about the joint sleeve (30), and when the front end of the positioning sleeve (40) is distant from the opening (32) the joint sleeve (30) is pivotable relative to the longitudinal axis of the shank (20).

2. The screwdriver as claimed in claim 1, wherein the free end (21) has a slot (211) transversally defined therethrough, and the joint sleeve (30) has a pair of apertures (33) defined at diametrically opposite sides thereof and in alignment with the slot (211), and a in (50) inserted through the apertures (33) and the slot (211).

3. The screwdriver as claimed in claim 1 further comprising a resilient member (51) received in the opening (32) and abutting the free end (21) whereby the shank (20) is urgeable from the joint sleeve (30).

4. The screwdriver as claimed in claim 1, wherein the free end (21) is ball-shaped.

5. The screwdriver as claimed in claim 1, wherein the opening (32) further has a step (321) formed at an outer edge thereof.

6. The screwdriver as claimed in claim 1, wherein the joint (31) is substantially cubic.

* * * * *